US005883323A

United States Patent [19]

Kaufman

[11] Patent Number: 5,883,323

[45] Date of Patent: Mar. 16, 1999

[54] SENSE OF TOUCH ELECTRONIC TUNER

[76] Inventor: Jay Stephen Kaufman, 24 Scotland Rd., Kingston, N.H. 03848

[21] Appl. No.: 962,057

[22] Filed: Oct. 31, 1997

Related U.S. Application Data

[63] Continuation-in-part of Ser. No. 707,973, Aug. 30, 1996, abandoned.

[51] Int. Cl.[6] ..... G10G 7/02

[52] U.S. Cl. ..... 84/454

[58] Field of Search ..... 84/454

[56] References Cited

U.S. PATENT DOCUMENTS 4,608,904 9/1986 Steinberger ..... 84/304

*Primary Examiner*—William M. Shoop, Jr.
*Assistant Examiner*—Shih-yung Hsieh

[57] ABSTRACT

A sense of touch electronic tuning device with background noise suppression and tuning note identification features to verify tuning of acoustic and electrically amplified stringed, reed and wind musical instruments, said tuning device comprising a sound sensor, signal conditioning system, power supply, reference tuning note identification system and vibrator to produce vibration felt by the person using said tuning device when the musical instrument to which said tuning device is directly or indirectly connected, produces musical notes, in tune, within an acceptable tolerance range of acoustic pitch.

16 Claims, 9 Drawing Sheets

SENSE OF TOUCH ELECTRONIC TUNER

CROSS-REFERENCE TO RELATED APPLICATIONS

This is a continuation-in-part of my application Ser. No. 08/707,973, filed Aug. 30, 1996, entitled "Sense Of Touch Electronic Tuner", now abandoned.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to an accessory to verify the tuning of musical instruments and pertains particularly to an improved electronic tuner providing sense of touch indication for acoustic or electrically amplified stringed, reed, and wind instruments, the tuner being used by a person, hereinafter referred to as the "player". Musical notes from the instrument, hereinafter referred to as "tuning notes", are "in tune" when within an acceptable tolerance range of acoustic pitch determined by the tuner.

It is frequently necessary to adjust tuning of a musical instrument during use and tuning is typically verified by prior art tuners including oral pitch pipes, percussive tuning forks, or audible or visual electronic tuners. Pitch pipes, tuning forks and audible electronic tuners produce sounds to which the instrument is qualitatively tuned by ear, tuning accuracy depending on the sensitivity of the player's ear to pitch. Although visual electronic tuners provide quantitative indication that the instrument is in tune by a light display or rotating needle, they are not usable by blind musicians. Prior art tuners have the disadvantage that they must be handled during use so that the player's hands are not free to adjust tuning of the instrument and a place is not always available to physically rest the tuner. Some electronic tuners can be attached to the instrument to free the player's hands, but are distracting to view and difficult to position. Another problem with prior art electronic tuners is identification of a reference tuning note when the desired tuning note is substantially out of tune, requiring the use of a manual switch before automatic switching for the remaining tuning notes can take place. This problem occurs because an electronic tuner cannot distinguish between tuning notes of nearly the same pitch, for example D and E which are both a string on the guitar. The problem is further complicated by the inclusion of temporarily unused tuning notes in the tuner's sensing capability, such as D below low E, available for non-standard tuning, or the bass tuning notes of a combination bass-guitar tuner. Pick up of background noise is also an inherent problem with prior art tuners.

In the present invention I disclose an improved electronic tuner which picks up minimal background noise and provides rapid and accurate indication that selected tuning notes are in tune by quiet vibration, conveniently felt by both blind and sighted players. Three alternate component arrangements improve upon the convenience of tuner location, including; placement of all tuner components on the musical instrument; placement of the vibrator on the person of the player, connected by radio transmission, to the sensor attached to the instrument; or placement of the tuner on the person of the player with sealed contact between the instrument and the sound sensor attached to the tuner. These tuner placement options free the player's hands to rapidly adjust tuning without distraction and it is not required to find a place to rest the tuner. Improved tuning note identification with the tuner of the present invention eliminates the need for manual switching. One tuning sequence option is to first distinguish a reference tuning note by intermittent vibrator operation and then identify the remaining tuning notes by steady vibrator operation. Another tuning sequence is to distinguish the reference tuning note by vibrator operation at a frequency which is substantially different than the frequency used to identify the remaining tuning notes. Many other tuning note identification sequences are possible using variations of these basic sequences. Tuning note identification by sense of touch is preferred to audible or visual methods because quiet and fully automatic rapid tuning can be performed while the player's hands are free of distracting switch operation. Pick up of background noise is reduced with the tuner of the present invention because the sensor is either in contact with or inside of the instrument.

BRIEF SUMMARY OF THE INVENTION

It is the primary object of the present invention to provide an improved tuner to verify tuning of acoustic and electrically amplified stringed, reed and wind musical instruments.

In accordance with a primary aspect of the present invention, a tuner for verifying the pitch of stringed, reed and wind musical instruments comprises appropriate means of attachment and electrically connected components and systems including a sound sensor, power supply with on-off switch, vibrator, signal conditioning system, and tuning note switching and identification system.

A feature of the tuner in accordance with the present invention lies in the provision of a rotating eccentric weight vibrator driven by an electromagnetic motor which produces vibration to indicate to the player by sense of touch that selected tuning notes are in tune.

Another feature of the tuner in accordance with the present invention lies in providing an attachment to the eccentric weight vibrator, such as an elongated elastic bar designed to vibrate in resonance with the vibrator, to indicate to the player at a convenient location on the instrument by sense of touch that selected tuning notes are in tune.

Another feature of the tuner in accordance with the present invention lies in the provision of an alternate vibrator configuration comprising an electronic or piezo-electric driven diaphragm located on the instrument which vibrates to indicate to the player by sense of touch that selected tuning notes are in tune.

Another feature of the tuner of the present invention lies in the provision of a tuning note switching and identification system to establish a reference tuning note by intermittent vibrator operation with identification of the remaining tuning notes by steady vibrator operation.

Another feature of the tuner in accordance with the present invention lies in the provision of an alternate tuning note switching and identification system to establish a reference tuning note by vibrator operation at a frequency which is substantially different than the frequency used to identify the remaining tuning notes.

Another feature of the tuner in accordance with the present invention lies in locating all components of the tuner on the instrument to produce vibration of a zone, diaphragm, or extension of the vibrator to minimize pick up of background noise and improve the convenience of tuner location.

Another feature of the tuner in accordance with -the present invention lies in locating the tuner including the sound sensor and the vibrator on the person of the player with provision of sealed contact between the musical instrument and the sound sensor to minimize pick up of background noise and improve the convenience of tuner location.

Still another feature of the tuner in accordance with the present invention lies in provision of radio connection, between the sound sensor as part of a transmitter located on the instrument and the vibrator as part of a receiver located on the person of the player, to minimize pick up of background noise and to improve the convenience of tuner component location.

Further objects, advantages and features of the present invention, together with the organization and manner of operation thereof, will become apparent from the following detailed description of the invention when taken in conjunction with the accompanying drawings wherein like reference numerals designate like elements throughout.

BRIEF DESCRIPTION OF THE SEVERAL VIEWS OF THE DRAWINGS

The above and other objects and advantages of the present invention will become apparent from the following description when read in conjunction with the accompanying drawings wherein.

DETAILED DESCRIPTION OF THE INVENTION

Figure 1:
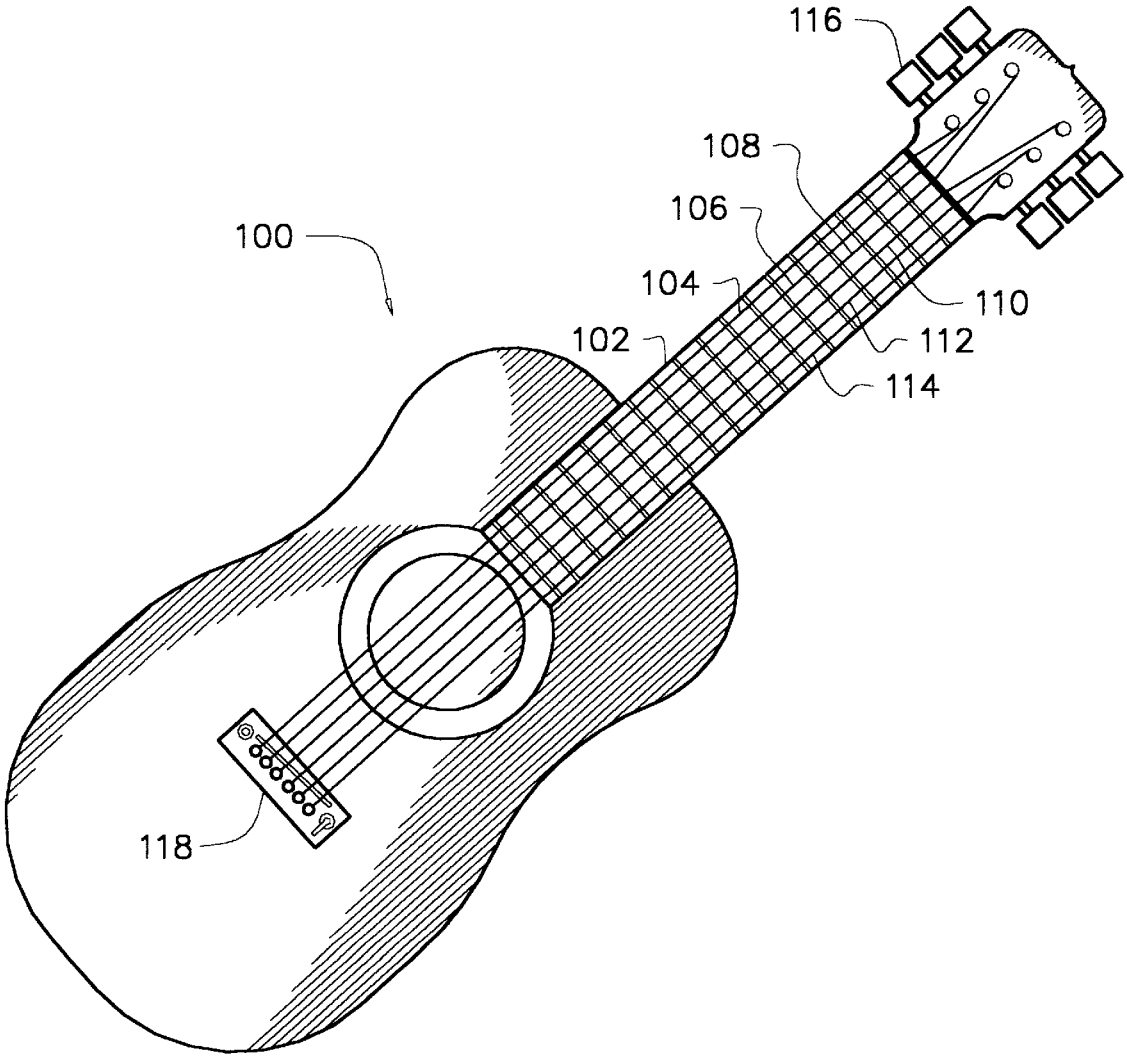
FIG. 1 is a top plan view illustrating the parts of a guitar required to describe embodiments of the invention.
Figure 2:
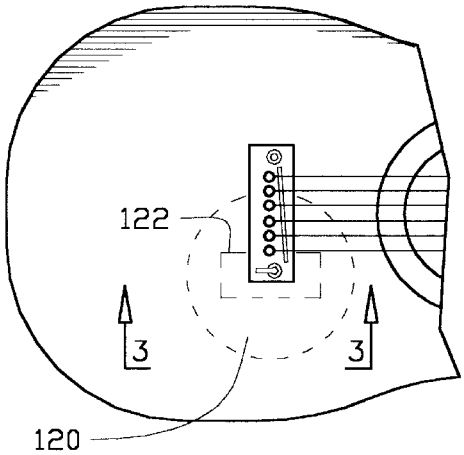
FIG. 2 is a top plan view illustrating an embodiment of a tuner of the present invention in use.
Figure 3:
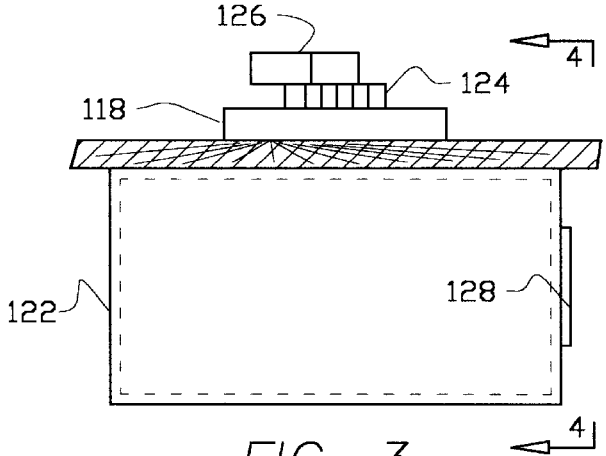
FIG. 3 is a section view taken on line 3 of FIG. 2.
Figure 4:
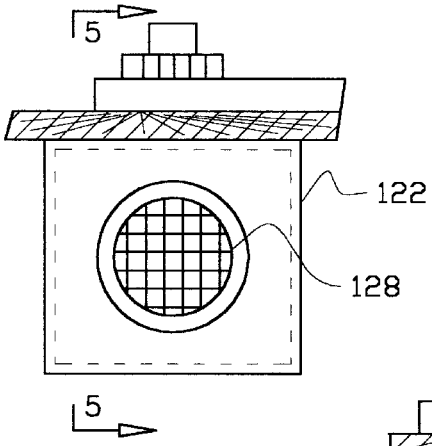
FIG. 4 is a section view taken on line 4 of FIG. 3.

Referring to the drawings, and particularly to FIG. 1, there is shown an exemplary embodiment of a guitar 100 to illustrate installation of a sense of touch electronic tuner in accordance with the present invention for verification of tuning of the guitar. The guitar has a neck 102 over which a plurality of spaced apart strings; 104, 106, 108, 110, 112, and 114, are aligned. Tension is adjusted in string 104 by a tension adjuster 116 and in the remaining strings by similar adjusters, the other end of each string being fastened to a bridge 118. FIG. 2 shows the tuner positioned inside of the guitar to effect vibration, as required, of a zone 120 on the top surface of the guitar. The strings are known to be in tune when tensioned such that the tuner, sensing a note within an allowable range of acoustic pitch from each string separately, provides indication to a player by touch of zone 120. FIGS. 3 and 4 are two views of a tuner case 122 attached to the underside of the bridge by a fastener 124. The tuner is turned on by a switch 126 and sound from the guitar is picked up by a sensor 128.

Figure 5:
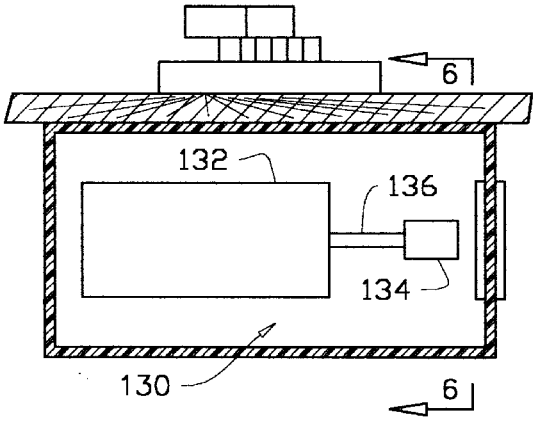
FIG. 5 is a section view taken on line 5 of FIG. 4.
Figure 6:
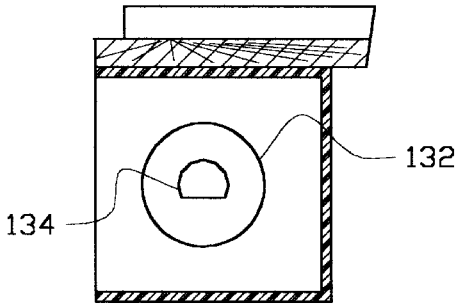
FIG. 6 is a section view taken on line 6 of FIG. 5.

Referring to FIGS. 5 and 6, two views of tuner case 122 illustrate a vibrator 130 which transmits vibration to the tuner case 122. Vibration is produced by an electro-magnetic motor 132 turning an eccentric weight 134 attached to a shaft 136. The coreless eccentric weight type vibrator, in accordance with a preferred embodiment of the invention is quiet, compact and light weight having a diameter of 0.25 inch, length of 0.60 inch and weight of 0.10 ounces. All other components of the tuner, electrically connected as required, are contained in the tuner case.

Figure 7:
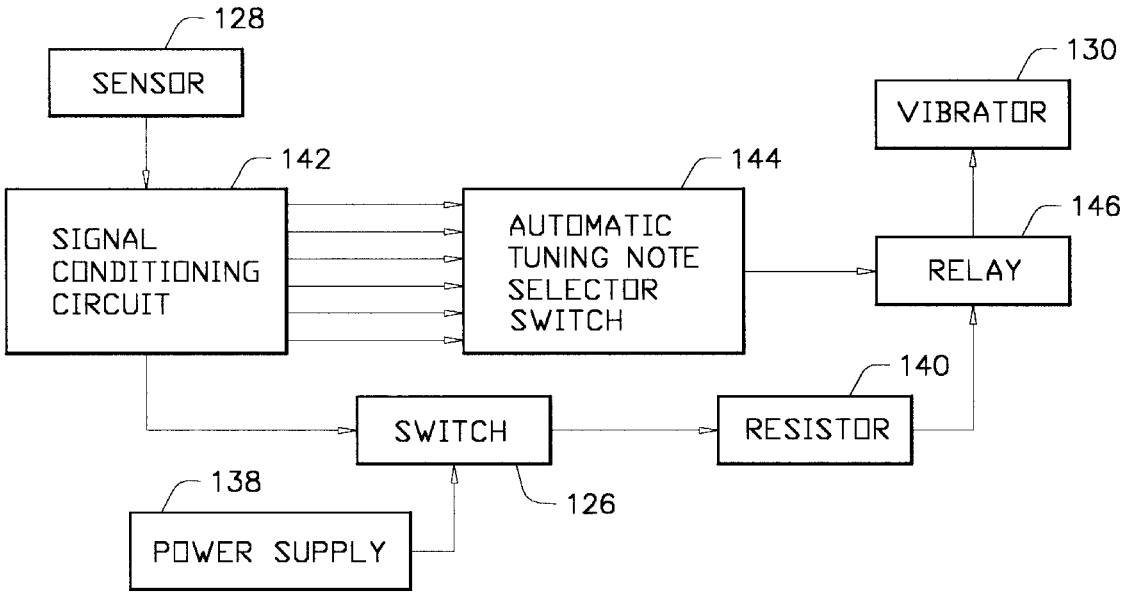
FIG. 7 is a block diagram of the tuner according to the present invention.

Referring to FIG. 7, a block diagram of the tuner of the present invention in accordance with the arrangement of FIG. 2 describes the function and shows connection of the primary electrical components. Conventional energizer circuitry includes a power supply 138 with switch 126, power being adjusted by a resistor 140 to run vibrator 130, as required. Conventional tuner circuitry to process sound from the guitar includes, typically: sensor 128 to pick up sound from the guitar and convert it to electrical signals; a signal conditioning circuit 142 to filter, analyze, and compute the deviation in pitch of the electrical signals from internally generated assigned signals corresponding to each of the tuning notes; and an automatic tuning note selector switch 144 which outputs electrical signals corresponding to the selected tuning notes. Standard tuning notes for guitar comprise low E for string 104, A for string 106, D for string 108, G for string 110, B for string 112, high E for string 114, and D below low E for string 104 which is included to extend the tuning range for non-standard tunings. The A string with a fundamental frequency of 220 cycles per second is one octave below A of 440 cycles per second, the standard international reference. Vibrator circuitry of the present invention processes the appropriate electrical signals to actuate a relay 146 and run the vibrator as required.

Operation of the tuner of the present invention is fully automatic with indication of tuning notes by sense of touch while conventional electronic tuners require a preliminary procedure to establish a reference tuning note from a pitch pipe, tuning fork or similar audible source, or operation of a manual tuning note selector switch which requires visual observation. Using the tuner to put the guitar in standard tuning while plucking the low E string 104, tension is slackened and gradually increased using adjuster 116 until a first vibration of zone 120 on the guitar is felt in the fingers, hand, or forearm of the player. The first vibration indicates D below low E and tensioning is continued until a second vibration corresponding to low E is felt. Next, the A string 106 is similarly tuned using the appropriate adjuster until pitch of the A string is heard to just exceed pitch of the low E string, tensioning then continuing until vibration of zone 120 is felt as before. The tuning process is continued sequentially for the remaining strings in the same manner, comparing pitch of the string being tuned to the pitch of the lower adjacent string by ear, then tensioning further until vibration is felt.

Figure 8:
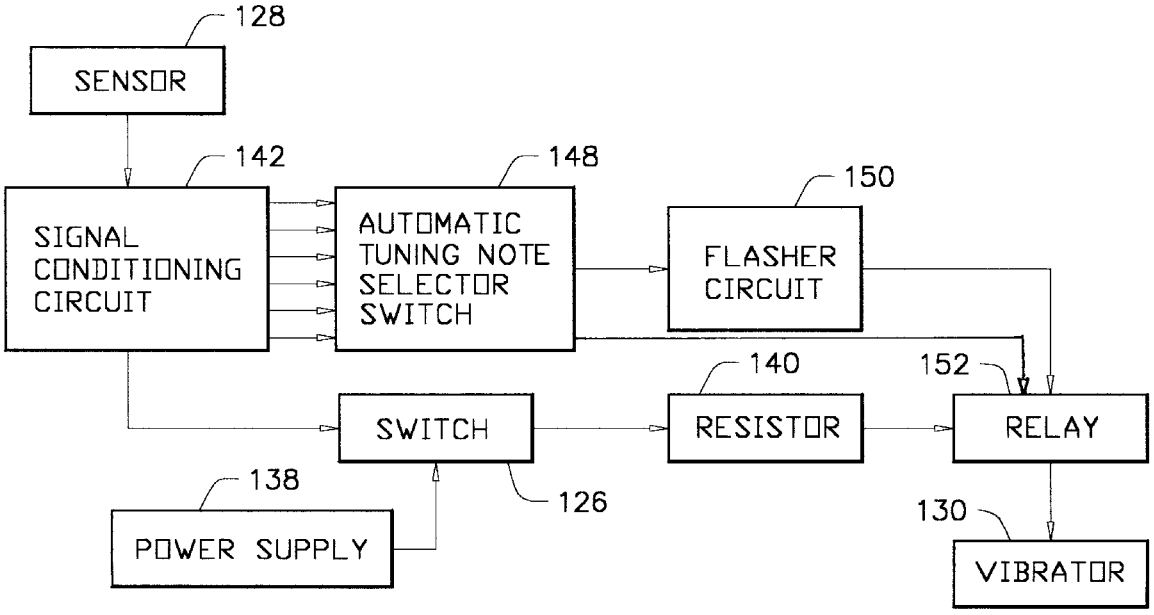
FIG. 8 is a block diagram of the tuner according to the present invention illustrating an alternate tuning note indication scheme.
Figure 9:
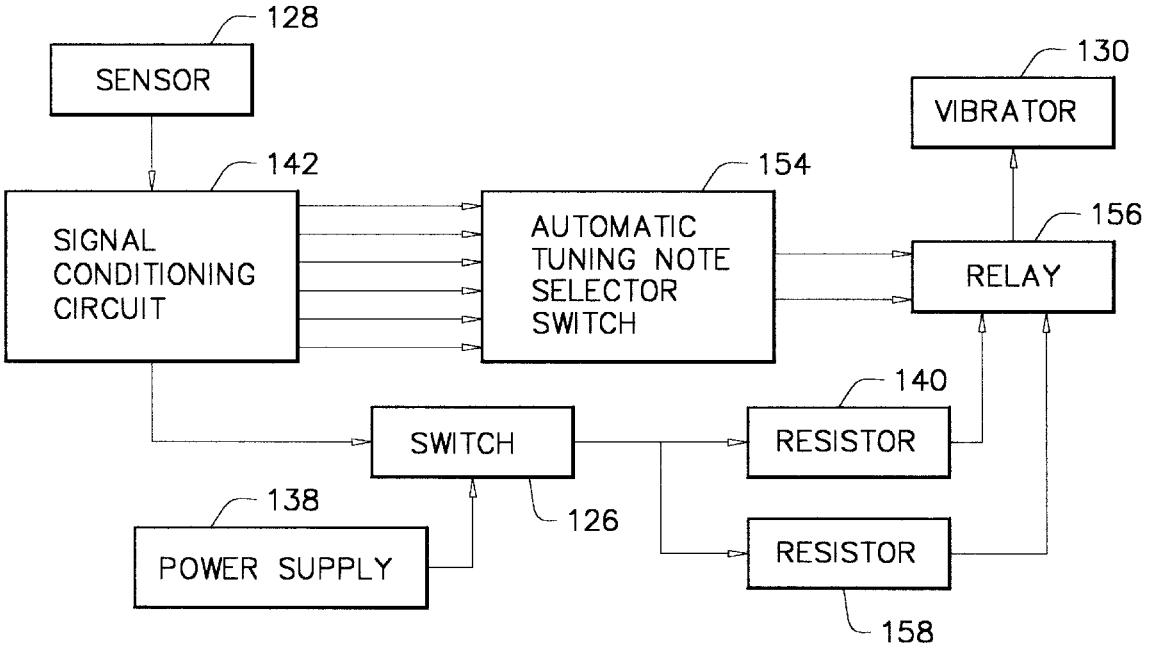
FIG. 9 is a block diagram of the tuner according to the present invention illustrating another alternate tuning note indication scheme.

Referring to FIGS. 8 and 9, two alternate embodiments of the block diagram of FIG. 7 are illustrated wherein the same elements are identified by the same numerals and equivalent or like elements are given their own numerals. FIG. 8 describes a preferred embodiment having the capability to positively identify a reference tuning note by intermittent vibrator operation. Conventional energizer circuitry comprising power supply 138, switch 126, and resistor 140, and tuner circuitry comprising sensor 128 and signal conditioning circuit 142, are the same as described in FIG. 7. A conventional automatic tuning note selector switch 148 provides appropriate electrical signals to either a flasher circuit 150 to actuate a relay 152 and intermittently run vibrator 130 for identification of the reference tuning note, or directly to the relay to provide continuous vibrator operation for identification of the remaining tuning notes.

Operation of the tuner of the present invention with the intermittent reference tuning note identification system of FIG. 8 is similar to operation of the system of FIG. 7. To put the guitar in standard tuning vibration is felt, for example, in the following order; 80 cycles per second intermittently at 2 starts and stops per second for low E string 104, steady 80 cycles per second for A string 106, steady 80 cycles per second for D string 108, steady 80 cycles per second for G string 110, steady 80 cycles per second for B string 112, and steady 80 cycles per second for high E string 114.

FIG. 9 describes another preferred embodiment having the capability to positively identify the reference tuning note by vibrator operation at different frequencies. Conventional energizer circuitry comprising power supply 138 switch 126, and resistor 140, and tuner circuitry comprising sensor 128 and signal conditioning circuit 142 are the same as described in FIG. 7. A conventional automatic tuning note selector switch 154 provides appropriate electrical signals to either actuate a relay 156 and run vibrator 130 at a high frequency with power supplied through a resistor 158 for identification of the reference tuning note, or actuate the relay and run the vibrator at a low frequency with power supplied through resistor 140 for identification of the remaining tuning notes.

Operation of the tuner of the present invention with the two frequency reference tuning note identification system of FIG. 9 is similar to operation of the systems of FIG. 7 and FIG. 8. To put the guitar in standard tuning vibration is felt, for example, in the following order; 120 cycles per second for low E string 104, 80 cycles per second for A string 106, 80 cycles per second for D string 108, 80 cycles per second for G 110, 80 cycles per second for B string 112, and 80 cycles per second for high E string 114.

Figure 10:
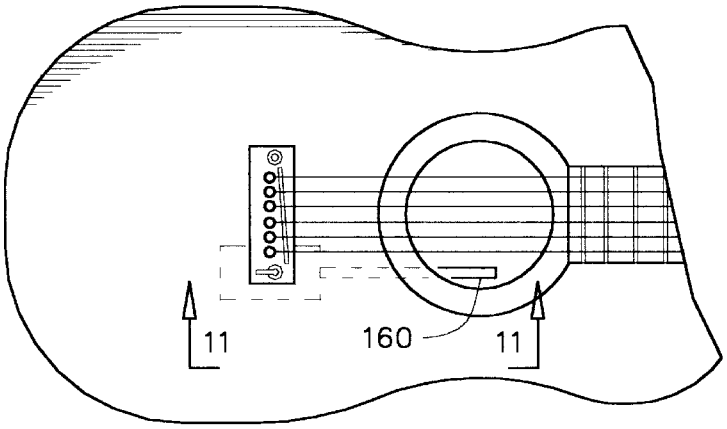
FIG. 10 is a top plan view of the tuner according to the present invention illustrating an alternate embodiment to feel vibration indicating tuning notes.
Figure 11:
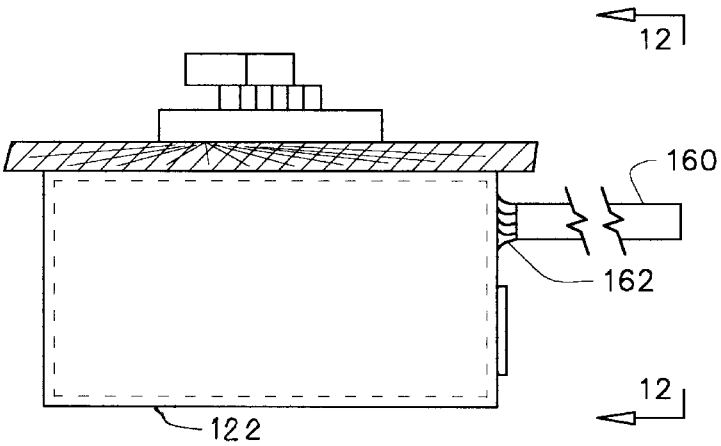
FIG. 11 is a section view taken on line 11 of FIG. 10.
Figure 12:
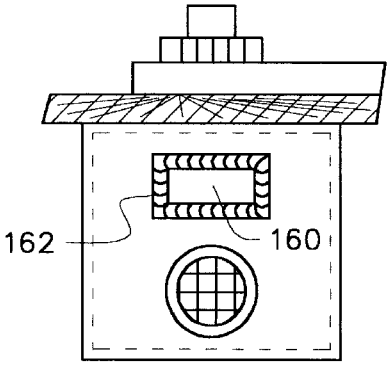
FIG. 12 is a section view taken on line 12 of FIG. 11.

Referring to FIG. 10 a modification of the embodiment of FIG. 2, comprising an elongated elastic bar 160 attached to tuner case 122, is illustrated. The bar transmits and amplifies vibration indicating tuning notes to a convenient location on the guitar where the vibration can be felt by one finger of the player. FIGS. 11 and 12 show two views of the bar with weld 162 provided to increase resonant vibration response of the bar. The embodiment of FIG. 10 can be used with the arrangements of the block diagrams of FIGS. 7, 8, or 9.

Figure 13:
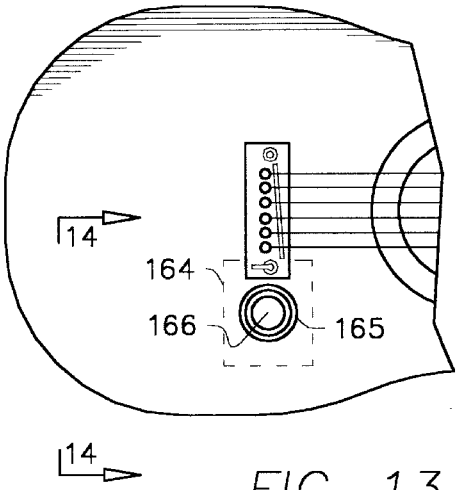
FIG. 13 is a top plan view of the tuner according to the present invention illustrating another alternate embodiment to feel vibration indicating tuning notes.
Figure 14:
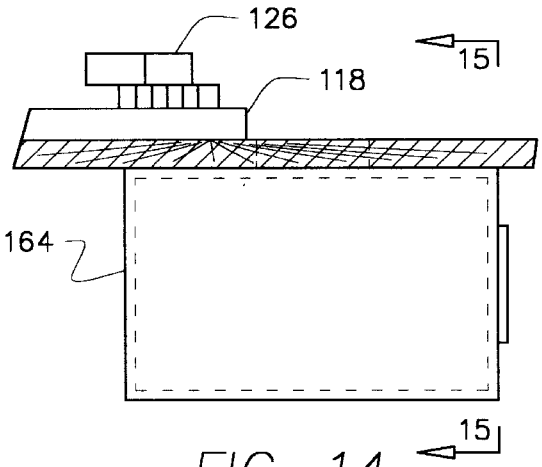
FIG. 14 is a section view taken on line 14 of FIG. 13.
Figure 15:
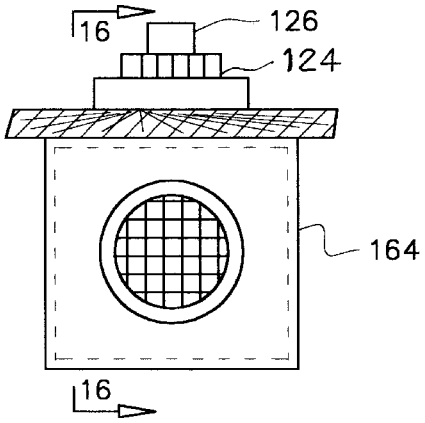
FIG. 15 is a section view taken on line 15 of FIG. 14.
Figure 16:
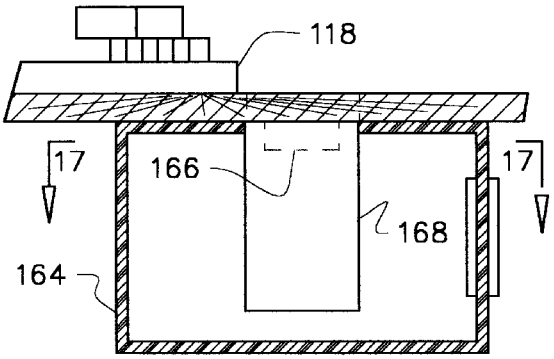
FIG. 16 is a section view taken on line 16 of FIG. 15.
Figure 17:
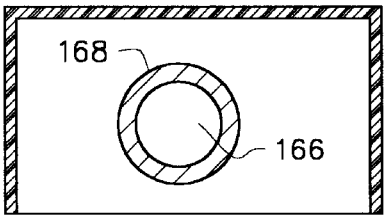
FIG. 17 is a section view taken on line 17 of FIG. 16.

Referring to FIG. 13, an alternate embodiment of vibrator 130 is illustrated which does not require vibration of intermediate components to provide tuning note indication to the player. Tuner case 164 has a vibrator diaphragm 166 directly accessible through an opening 165 in the top surface of the guitar, allowing the player to feel vibration indicating tuning notes with one finger. FIGS. 14 and 15 are two views of tuner case 164 illustrating attachment to the underside of bridge 118 by fastener 124. FIGS. 16 and 17 are two views of the tuner case showing installation of a vibrator 168 which uses a piezo-electric or electronic motor to drive the diaphragm. The tuner case also contains all components of the tuner, electrically connected, as required. The embodiment of FIG. 13 can be used with the arrangements of the block diagrams of FIGS. 7, 8, or 9.

Figure 18:
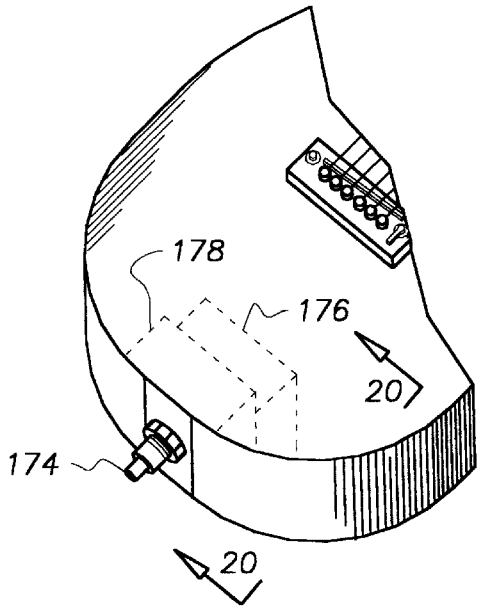
FIG. 18 is a perspective view of a portion of the tuner according to the present invention illustrating an alternate embodiment of component location.
Figure 20:
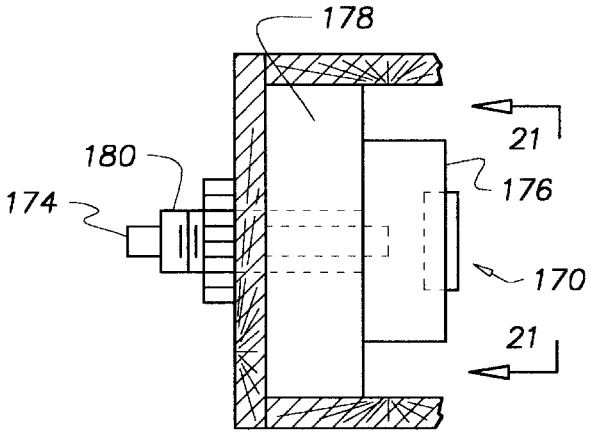
FIG. 20 is a section view taken on line 20 of FIG. 18.
Figure 21:
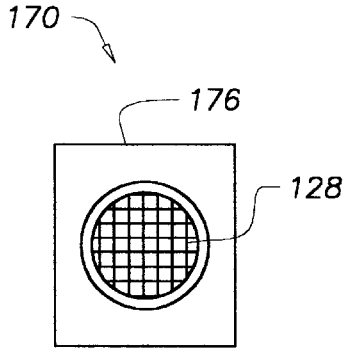
FIG. 21 is a section view taken on line 21 of FIG. 20.
Figure 19:
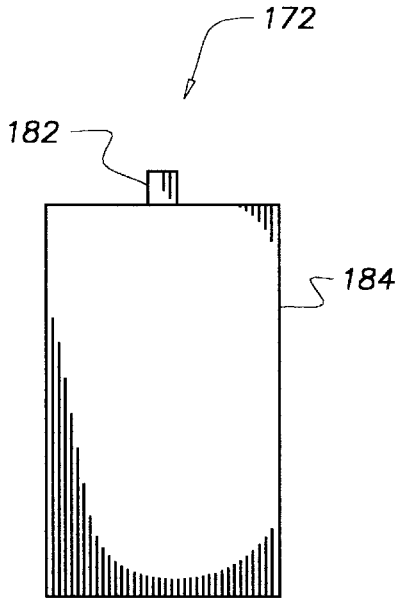
FIG. 19 is a front elevation view of the other portion of the tuner of FIG. 18.
Figure 22:
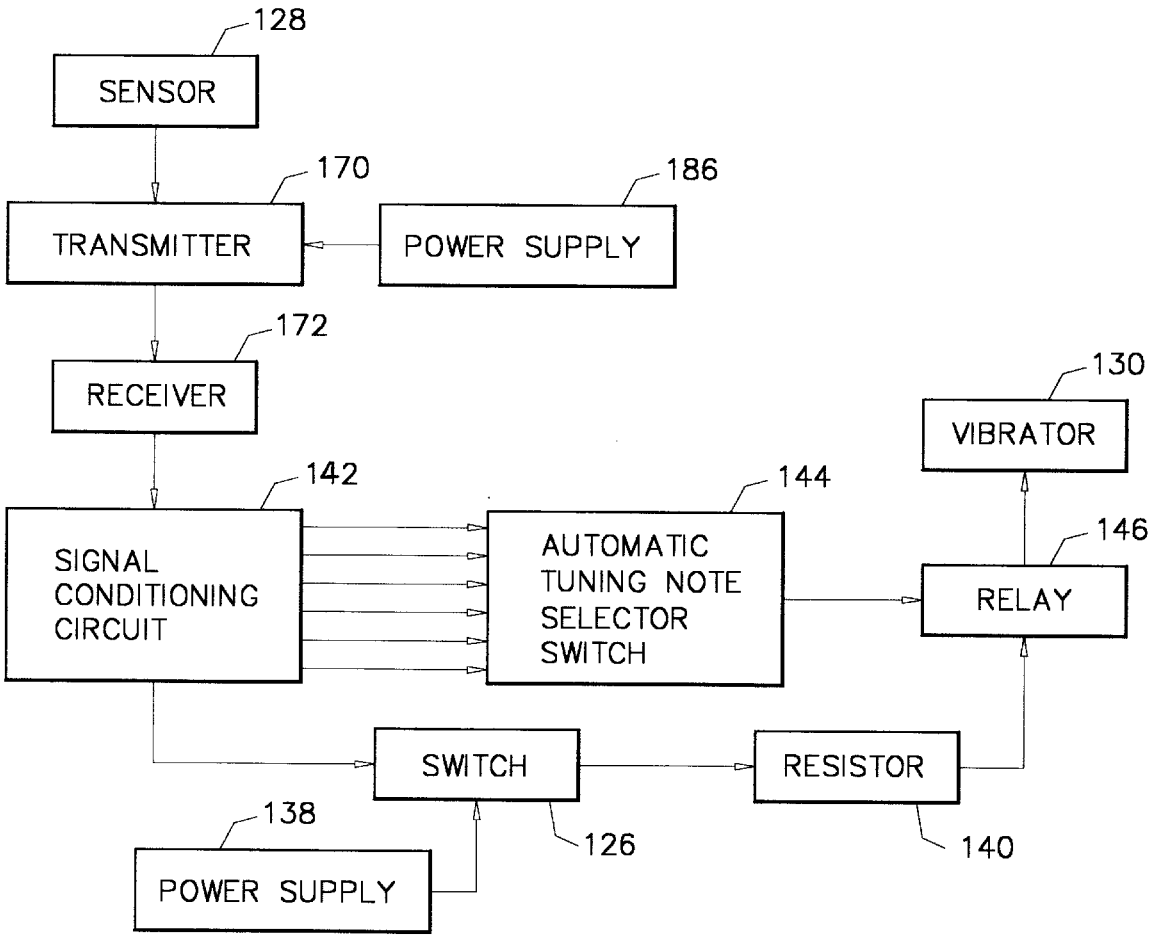
FIG. 22 is a block diagram of the embodiment of FIGS. 18 and 19 of the tuner according to the present invention.

A further embodiment of the tuner of the present invention provides radio transmission between a portion of the tuner located on the guitar and a portion of the tuner located on the person of the player to indicate tuning notes. FIG. 18 shows the portion of the tuner of the present invention defined as a transmitter 170 located inside of the guitar. FIG. 19 shows the portion of the tuner of the present invention defined as a receiver 172 which is located in a pocket on the person of the player during use, vibration of the receiver indicating to the player by feel that particular tuning notes are within an allowable range of acoustic pitch. Two views of the transmitter are shown in FIGS. 20 and 21 wherein an antenna 174 for sending radio waves extends from a transmitter case 176 containing conventional radio transmitter circuitry and circuitry of the tuner, the case being attached to an integral block 178 of the guitar by a fastener 180. The receiver, FIG. 19, has an antenna 182 for receiving radio waves extending from a receiver case 184 containing conventional radio receiver circuitry and circuitry of the tuner. The transmitter 170 and receiver 172 embodiment of the tuner of the present invention can be used with the arrangements of the block diagrams of FIGS. 7, 8 or 9 for tuning note identification by connection of the electrical output of receiver 172 to the input of signal conditioning circuit 142. For illustrative purposes the block diagram of FIG. 22 describes the function and shows connection of the primary electrical components using the arrangement of the block diagram of FIG. 7. Sound from the guitar is picked up and converted to corresponding electrical signals by sensor 128, the signals then being conducted to transmitter 170 and sent as corresponding radio waves. Energy to the transmitter is provided by a conventional transmitter power supply 186. The receiver picks up the same radio waves and outputs corresponding electrical signals which are conducted to conventional signal conditioning circuit 142 and processed to actuate vibrator 130.

Figure 23:
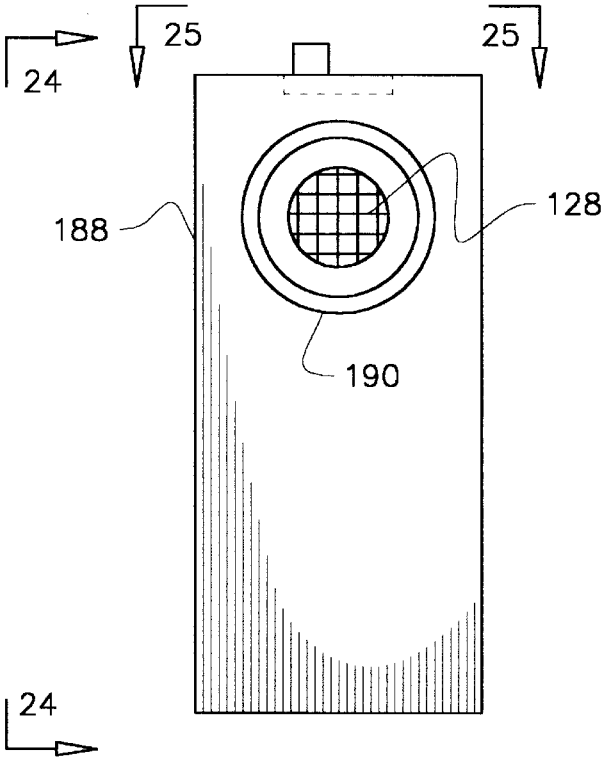
FIG. 23 is a front elevation view of the tuner according to the present invention illustrating another alternate embodiment of component location.
Figure 24:
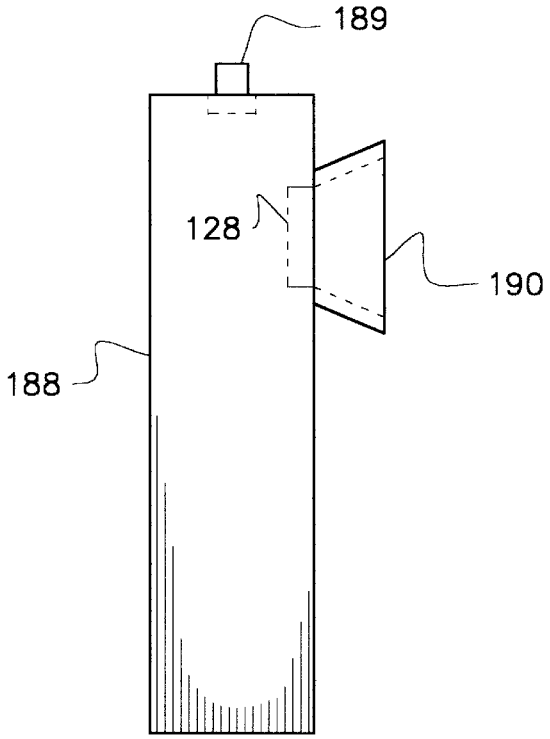
FIG. 24 is a section view taken on line 24 of FIG. 23.
Figure 25:
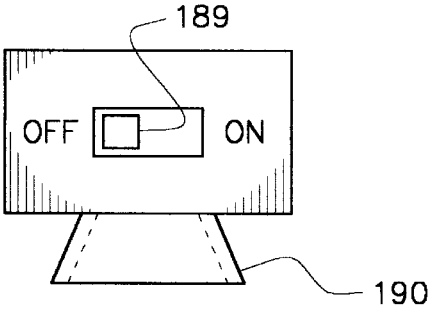
FIG. 25 is a section view taken on line 25 of FIG. 23.

Referring to FIGS. 23, 24, and 25 there is illustrated three views of a still further and preferred embodiment. All components of the tuner of the present invention are contained in a tuner case 188 located in a shirt pocket on the person of the player during use. A modification of sensor 128 includes attachment of a flexible seal surface 190 which is oriented to make contact with guitar 100. This modification is a preferred embodiment because it restricts background noise to the sensor and provides for convenient placement of the tuner. Sound from the guitar is picked up by the sensor and converted to electrical signals to actuate vibrator 130 as described by the arrangements of the block diagrams of FIGS. 7, 8, or 9. The tuner is turned on by switch 189 and vibration indicating tuning notes is felt by holding the guitar in contact with the sensor seal surface.

A prototype of the tuner of the present invention was constructed in accordance with the embodiment FIG. 23 and used to demonstrate the use of the touch tuning method of the present invention. A conventional electronic tuner, QUIK TUNE model QT-4 having automatic tuning note selection and a light emitting diode to indicate the strings of a guitar to be in tune, was used. The components of the QT-4 tuner were remounted in an enclosure which was placed in a player's shirt pocket, the microphone being fitted with a flexible seal ring around its periphery and oriented to contact a guitar held by the player. The light emitting diode was removed and connection made from the approximately 2.0 volt DC light emitting diode terminals to the signal input terminals of a Teledyne model C 60-20 relay to actuate and run a Namiki model 7CE-1701 coreless DC motor with eccentric weight which was connected to the power output terminals of the relay. It was possible to rapidly and accurately tune the guitar by feel of vibration at approximately 200 cycles per second through the player's shirt pocket.

It is understood that the tuner of the present invention can be made with other electronic circuit designs, that the tuner can be made for instruments having any number of strings in both standard and non-standard tunings by including appropriate reference signals and, that the tuner can be designed for use by wind, reed and electrically amplified instruments. It is also understood that the tuner can be provided with additional vibrator speeds or different intermittent start and stop rates to identify desired tuning notes. It is further understood that the tuner can be placed at any convenient location and attached in any suitable manner on the musical instrument or on the person of the player with appropriate extensions provided to access both the sensor and the vibrator.

While I have illustrated and described my invention by means of specific embodiments, it is to be understood that numerous changes and modifications may be made therein without departing from the spirit and scope of the invention as defined in the appended claims.

I claim:

1. A tuning device for use by a person to verify the pitch of selected tuning notes emitted by a musical instrument, said tuning device producing vibration felt by tactile means at a selected location on the body or any appendages of said person, indicating to said person that one or more tuning notes emitted by said musical instrument are within an acceptable tolerance range of acoustic pitch, said tuning device comprises:

a vibrator means to cause vibration felt by said person's sense of touch when one or more tuning notes emitted by said musical instrument are within an acceptable tolerance range of acoustic pitch;

a sensor means to sense the sound emitted by said musical instrument or to sense the motion of one or more sound producing elements of said musical instrument and convert said sound or motion to corresponding electrical output signals;

a signal conditioning means to filter, analyze, and compute the deviation in pitch of the sensing means output signals from internally generated assigned signals corresponding to each of the tuning notes;

a tuning note selector and switching means to select appropriate electrical signals from the output of said signal conditioning means corresponding to the desired tuning notes and actuate said vibrator means, as required and;

a power supply means switch to energize said tuning device.

2. The tuning device according to claim 1 wherein: said vibrator means, said sensor means, said signal conditioning means, said tuning note selector and switching means, and said power supply means, having suitable electrical connection, are affixed to said musical instrument.

3. The tuning device according to claim 1 wherein: said sensor means having suitable electrical connection is affixed to said musical instrument and said vibrator means, having suitable electrical connection, is affixed to said person.

4. The tuning device according to claim 2 wherein: said sensor means provides appropriate electrical signals to a transmitter means located on said musical instrument and said transmitter means, in turn, sends appropriate electromagnetic signals to a receiver means located on said person to actuate said vibrator means when one or more tuning notes emitted by said musical instrument are within an acceptable tolerance range of acoustic pitch.

5. The tuning device according to claim 1 wherein: said vibrator means, said sensor means, said signal conditioning means, said tuning note selector and switching means, and said power supply means, having suitable electrical connection, are affixed to said person.

6. The tuning device according to claim 4 wherein: said sensor means comprises a microphone with an attached flexible seal surface means to make contact with said musical instrument.

7. The tuning device according to claim 1 wherein: said vibrator means is driven by electro-magnetic means, said vibrator means comprising components, as required, to cause vibration of a part of, or an attachment to said musical instrument, when said musical instrument emits one or more selected tuning notes within an acceptable tolerance range of acoustic pitch.

8. The tuning device according to claim 6 wherein: said electro-magnetic means spins an eccentric weight to cause intermittent or steady vibration at selected frequencies indicating to said person by sense of touch means that one or more tuning notes emitted by said musical instrument are within an acceptable tolerance range of acoustic pitch.

9. The tuning device according to claim 1 wherein: said vibrator means comprises a diaphragm part driven by piezoelectric means or electronic means to cause intermittent or steady vibration of said diaphragm at selected frequencies indicating to said person by sense of touch means that one or more selected tuning notes emitted by said musical instrument are within an acceptable tolerance range of acoustic pitch.

10. The tuning device according to claim 1 wherein: an elongated elastic bar is affixed to said vibrator means and driven at resonance by said vibrator means indicating to said person by sense of touch means that one or more selected tuning notes emitted by said musical instrument are within an acceptable tolerance range of acoustic pitch.

11. The tuning device according to claim 1 wherein: said tuning note selector and switching means has automatic switching capability for tuning note selection.

12. The tuning device according to claim 10 wherein: said tuning note selector and switching means causes operation of said vibrator means at two or more frequencies thereby providing said person with sense of touch means to identify reference tuning notes.

13. The tuning device according to claim 10 wherein: said tuning note selector and switching means causes intermittent operation of said vibrator means thereby providing said person with sense of touch means to identify reference tuning notes.

14. The tuning device according to claim 12 wherein: intermittent actuation of said vibrator means is provided by a flasher circuit means.

15. A method for verifying the tuning of a musical instrument for use by a person tuning said musical instrument comprising the steps of; playing selected tuning notes in sequence on said musical instrument, processing the sound of said musical notes first through a sound sensing means to convert said sound to corresponding electrical signals, then processing said electrical signals through suitable signal conditioning and tuning note selector switching means, thereby actuating a vibrator means indicating to said person by sense of touch means that said tuning notes are within an acceptable tolerance range of acoustic pitch.

16. A tuning device for verifying the pitch of selected musical notes emitted by a musical instrument, said tuning device being affixed to the person using said tuning device and having electrically and physically connected components comprising:

a vibrator driven by an electro-magnetic motor spinning an eccentric weight to cause intermittent vibration indicating a reference tuning note, and said weight causing steady vibration indicating the remaining tuning notes to said person by sense of touch that said reference and said remaining tuning notes emitted by said musical instrument are within an acceptable tolerance range of acoustic pitch;

a microphone with an attached flexible sealing surface to make contact with said musical instrument, sense the sound emitted by said musical instrument, and convert said sound to corresponding electrical output signals;

a signal conditioning circuit to filter, analyze and compute the deviation in pitch of the microphone output signals from internally generated assigned signals corresponding to each of the tuning notes;

a tuning note selector switch to select electrical signals from the output of said signal conditioning circuit corresponding to the desired tuning notes causing appropriate vibration indicating a reference tuning note and the remaining tuning notes;

a power supply with an on-off switch to energize said tuning device.

* * * * *